US011319868B2

(12) United States Patent
Kimura

(10) Patent No.: US 11,319,868 B2
(45) Date of Patent: May 3, 2022

(54) INTAKE DUCT FOR INTERNAL COMBUSTION ENGINE

(71) Applicant: TOYOTA BOSHOKU KABUSHIKI KAISHA, Aichi (JP)

(72) Inventor: Ryusuke Kimura, Ichinomiya (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 66 days.

(21) Appl. No.: 16/927,268

(22) Filed: Jul. 13, 2020

(65) Prior Publication Data

US 2021/0017897 A1 Jan. 21, 2021

(30) Foreign Application Priority Data

Jul. 19, 2019 (JP) ..... JP2019-133627

(51) Int. Cl.
*F02B 27/02* (2006.01)

(52) U.S. Cl.
CPC ..... *F02B 27/0215* (2013.01)

(58) Field of Classification Search
CPC ..... F02B 27/0215; F02M 35/10321; F02M 35/10334; F02M 35/10354; F02M 35/1272
See application file for complete search history.

(56) References Cited

U.S. PATENT DOCUMENTS 6,553,953 B1 * 4/2003 Fujihara ..... F02M 35/1272 123/184.21
2004/0159298 A1 * 8/2004 Ino ..... F02M 35/10354 123/184.21
2006/0086334 A1 * 4/2006 Uematsu ..... B29C 66/114 123/184.42
2011/0100315 A1 * 5/2011 Vichinsky ..... F02M 35/10321 123/184.53
2014/0338627 A1 * 11/2014 Yamaguchi ..... F02D 9/1095 123/184.21
2019/0389143 A1 * 12/2019 Kimura ..... B29C 66/1312
2020/0049112 A1 * 2/2020 Kimura ..... F02M 35/10347
2020/0309074 A1 * 10/2020 Kimura ..... F02M 35/10091

FOREIGN PATENT DOCUMENTS

JP 2011-208503 10/2011
JP 5973857 7/2016

OTHER PUBLICATIONS

German Office Action issued in German Patent Application No. 10 2020 118 633.9, dated Nov. 30, 2020, together with an English translation thereof.

* cited by examiner

*Primary Examiner* — Carl C Staubach
(74) *Attorney, Agent, or Firm* — Greenblum & Bernstein, P.L.C.

(57) ABSTRACT

An intake duct for an internal combustion engine includes a plurality of segments coupled together into a tubular shape. The segments include at least a first segment and a second segment. The first segment is formed from a material harder than the second segment. The first segment includes a groove that extends in the extending direction in a portion coupled to the second segment and projections that project from one of two inner surfaces of the groove. The second segment is formed from a material that allows for elastic deformation. The second segment includes a rib. The rib extends in the extending direction and has a projection width that is less than the opening width of the groove. The rib is fitted into the groove so that the projections locally compress the rib in the width direction of the groove.

7 Claims, 6 Drawing Sheets

INTAKE DUCT FOR INTERNAL COMBUSTION ENGINE

BACKGROUND

1. Field

The present disclosure relates to an intake duct for an internal combustion engine.

2. Description of Related Art

Japanese Patent No. 5973857 describes a tubular intake duct separated into two segments in an extending direction. In the intake duct, the ends of the two segments are joined so that the segments, which are coupled together, form a tubular shape. This seals the portion where the two segments are joined.

The publication also describes that at least one of the two segments is formed by a fibrous body such as an air permeable nonwoven fabric. This provides the peripheral walls of the intake duct with a noise reducing property.

A segment formed by a fibrous body is softer than a segment made of synthetic plastic. When an intake duct is formed by such a soft segment, a dedicated jig for joining the segments needs to be used to firmly support a portion close to the joined segments and accurately position the segments. Otherwise, the joined segments may be deformed in an undesirable manner and result in inappropriate joining. In this case, the formation of the intake duct will be a time-consuming task.

SUMMARY

It is an object of the present disclosure to provide an intake duct for an internal combustion engine that facilitates formation and allows for a satisfactory seal at a portion where segments are coupled together.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an intake duct for an internal combustion engine is provided. The intake duct includes a plurality of segments that extend in an extending direction and are coupled together into a tubular shape. The segments include at least a first segment and a second segment. The first segment is formed from a material harder than the second segment. The first segment includes a groove that extends in the extending direction in a portion coupled to the second segment and projections that project from one of two inner surfaces of the groove so as to decrease a width of the groove. The projections are spaced apart from each other in the extending direction inside the groove. The second segment is formed from a material that allows for elastic deformation. The second segment includes a rib at a portion where the second segment is joined with the first segment. The rib extends in the extending direction and has a projection width that is less than an opening width of the groove. The rib is fitted into the groove so that the projections locally compress the rib in a width direction of the groove.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An intake duct 20 for an internal combustion engine according to one embodiment will now be described.

Figure 1:
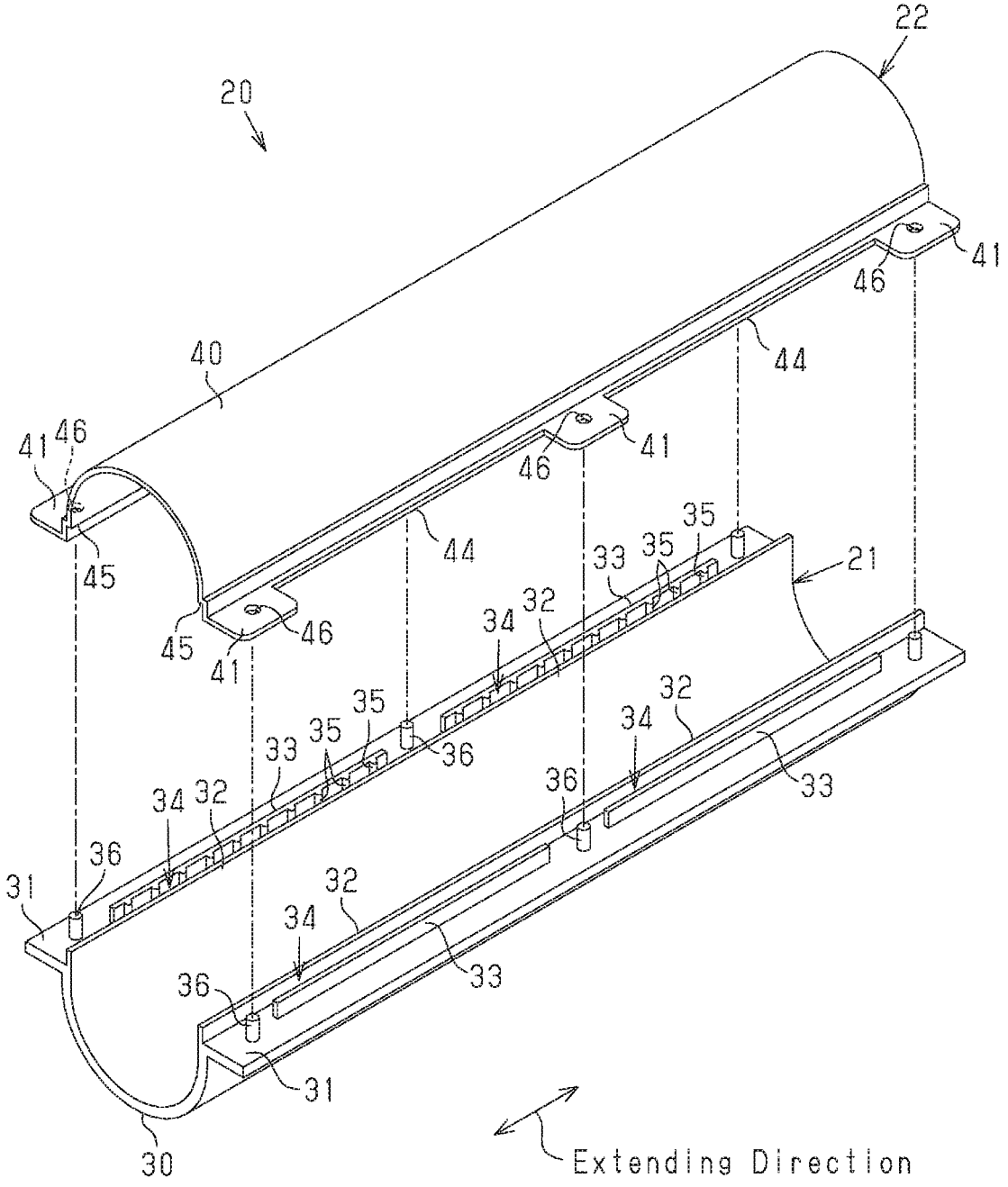
FIG. 1 is an exploded perspective view showing an intake duct according to one embodiment.
Figure 2A:
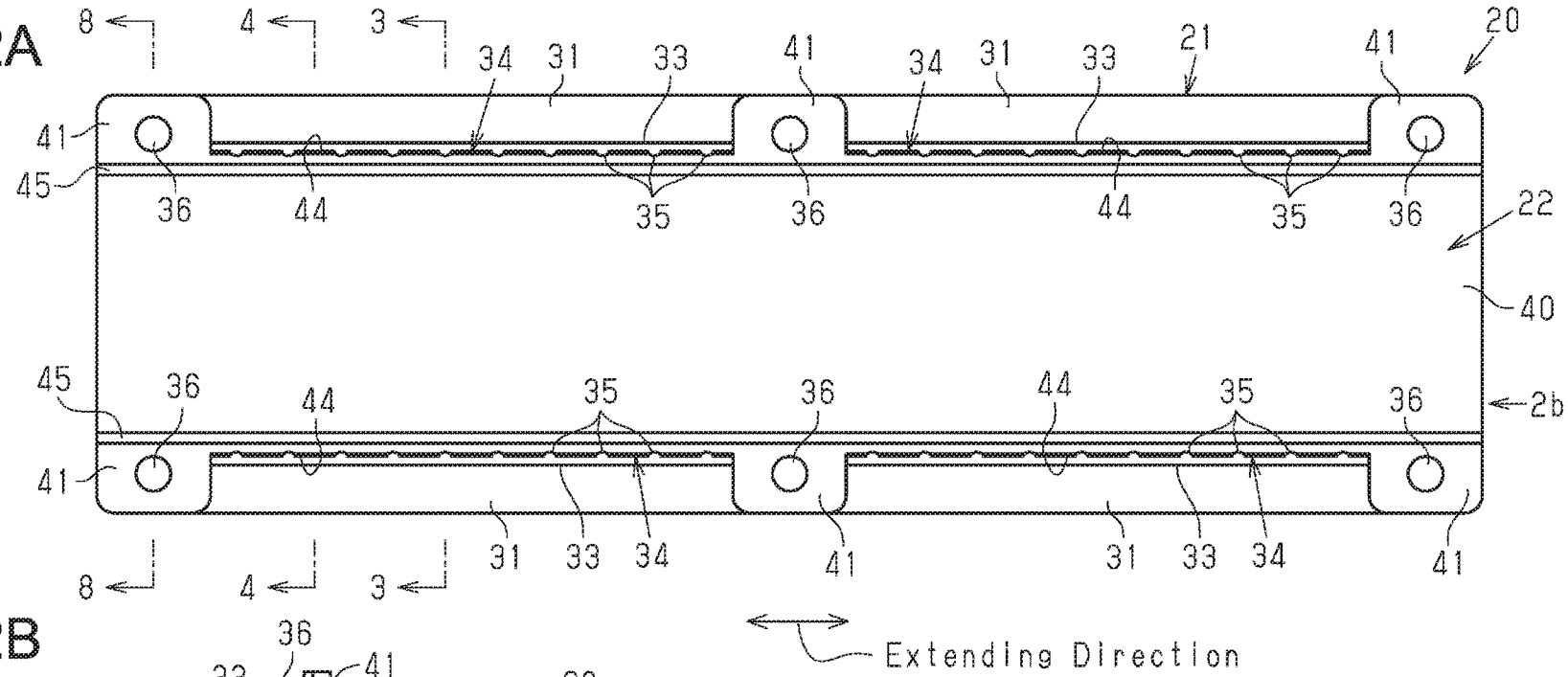
FIG. 2A is a plan view of the intake duct.
Figure 2B:
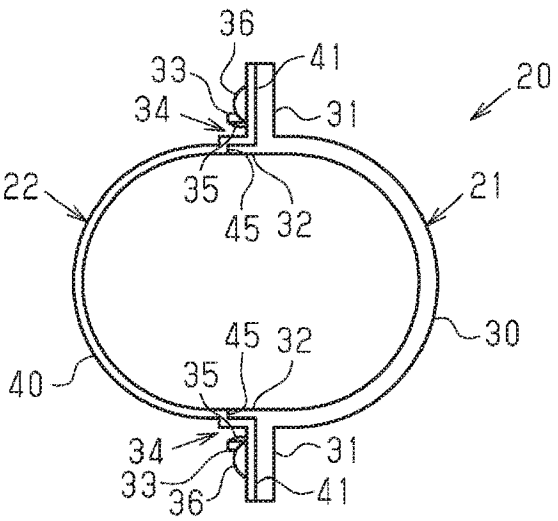
FIG. 2B is a view when the intake duct is observed in the direction of arrow 2*b* in FIG. 2A.

As shown in FIG. 1, the intake duct 20 is separated into a first segment 21 and a second segment 22 in an extending direction. As shown in FIGS. 2A and 2B, the first segment 21 and the second segment 22 of the intake duct 20 are coupled together into a tubular shape.

As shown in FIGS. 1 to 2B, the first segment 21 is made of a material that is harder than the second segment 22, specifically, a synthetic resin material. The first segment 21 includes a first duct portion 30 that has a substantially arcuate cross section and extends in the extending direction. The first duct portion 30 forms substantially one-half of the part of the intake duct 20 through which intake air passes.

The first segment 21 includes two flat flange portions 31 that project outward from the two ends of the arcuate cross section of the first duct portion 30. The flange portions 31 each extend over the entire length of the first duct portion 30 in the extending direction.

Each flange portion 31 includes an inner wall 32 and two outer walls 33 that extend in parallel to the inner wall 32. The inner wall 32 and the outer walls 33 extend in the extending direction and project toward the second segment 22 from the flange portion 31.

The inner wall 32 projects from the end of the arcuate cross section of the first duct portion 30. The inner wall 32 extends over the entire length of the first duct portion 30 in the extending direction. The inner wall 32 is arranged so that the first duct portion 30 has a continuously extending wall.

The two outer walls 33 of each flange portion 31 are spaced apart from each other in the extending direction. Specifically, the outer walls 33 of each flange portion 31 are arranged at two locations excluding the two ends and the center of the flange portion 31 in the extending direction.

In the present embodiment, a portion between the inner wall 32 and the outer walls 33 corresponds to a groove 34 that extends in the extending direction at a portion where the first segment 21 and the second segment 22 are coupled together.

Figure 3:
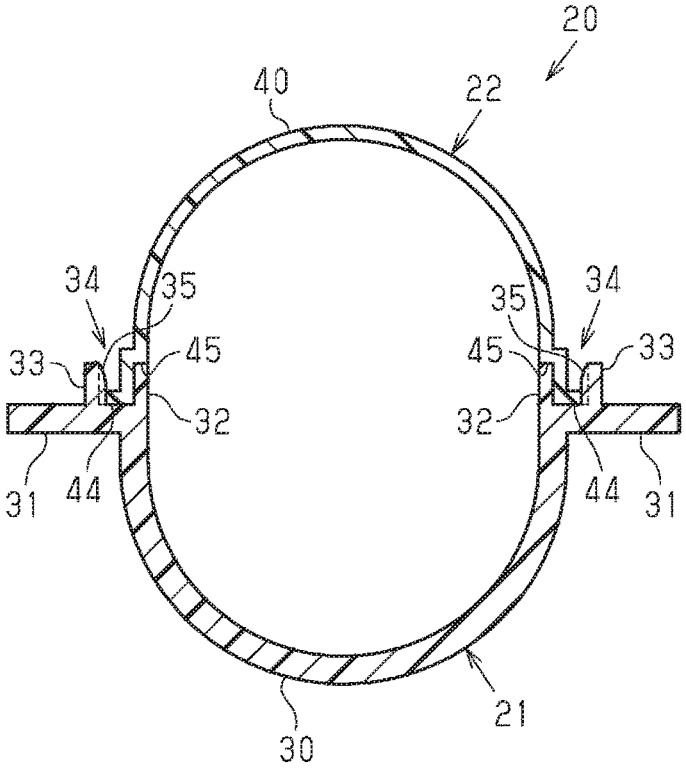
FIG. 3 is a cross-sectional view taken along line 3-3 in FIG. 2A.

The outer one of the two inner surfaces of the groove 34, that is, the inner surface of each outer wall 33, includes projections 35 that project to decrease the width of the groove 34. In the present embodiment, the projections 35 are formed only on the outer walls 33 and not formed on the inner wall 32. The projections 35 are arranged at equal intervals in the extending direction. The projections 35 each extend from the bottom to an open end of the groove 34 in a substantially semicircular cross section. As shown in FIG. 3, a portion of each projection 35 proximate to the opening of the groove 34 is shaped so that the amount of projection from the inner surface of the outer wall 33 increases as the opening of the groove 34 becomes farther. This increases the space between the end of each projection 35 and the inner surface of the groove 34 toward the opening of the groove 34.

As shown in FIGS. 1 to 2B, each flange portion 31 includes cylindrical swaging portions 36 used for heat swaging that will be described below. The swaging portions 36 project from the surface of the flange portion 31 that faces the second segment 22. Each flange portion 31 includes three swaging portions 36. The three swaging portions 36 of each flange portion 31 are arranged at the two ends and the center in the extending direction.

The second segment 22 is formed by a nonwoven fabric. Specifically, the nonwoven fabric is formed from a known sheath-core bicomponent fiber material including, a core (not shown) made of polyethylene terephthalate (PET) and a sheath made of a modified PET having a melting point lower than that of the PET fiber of the core (not shown). The modified PET of the nonwoven fabric functions as a binder that binds the PET together. The second segment 22, which is formed by the nonwoven fabric, is air-permeable and has properties that allow for some elastic deformation.

The second segment 22 includes a second duct portion 40 that has a substantially arcuate cross section and extends in the extending direction. The second duct portion 40 forms substantially one-half of the intake duct 20 through which intake air passes.

The second segment 22 includes substantially flat fixing portions 41 that project outward from the two ends of the arcuate cross section of the second duct portion 40. Each end of the arcuate cross section of the second duct portion 40 includes three fixing portions 41 that are spaced apart from one another in the extending direction. Specifically, each end of the arcuate cross section of the second duct portion 40 includes the three fixing portions 41 located at the two ends and the center in the extending direction. The fixing portions 41 extend to face parts of the flange portions 31 of the first segment 21 that do not include the outer walls 33, that is, portions where the swaging portions 36 are arranged. Each fixing portion 41 includes a through-hole 46 at a location that corresponds to the swaging portion 36 of the first segment 21.

In the present embodiment, when the intake duct 20 is formed, the swaging portions 36 of the flange portions 31 of the first segment 21 are inserted into the through-holes 46 of the fixing portions 41 of the second segment 22. In this state, heat swaging is performed to heat, press, and plastically deform the distal ends of the swaging portions 36. This fixes the fixing portions 41 of the second segment 22 to the flange portions 31 of the first segment 21.

In the second segment 22, the two ends of the arcuate cross section of the second duct portion 40 have portions that do not include the fixing portions 41, that is, portions between adjacent fixing portions 41 in the extending direction. The portions include ribs 44 that are fitted into the grooves 34 of the first segment 21. The distal end of each rib 44 has an L-shaped cross section and is bent outward.

Figure 4:
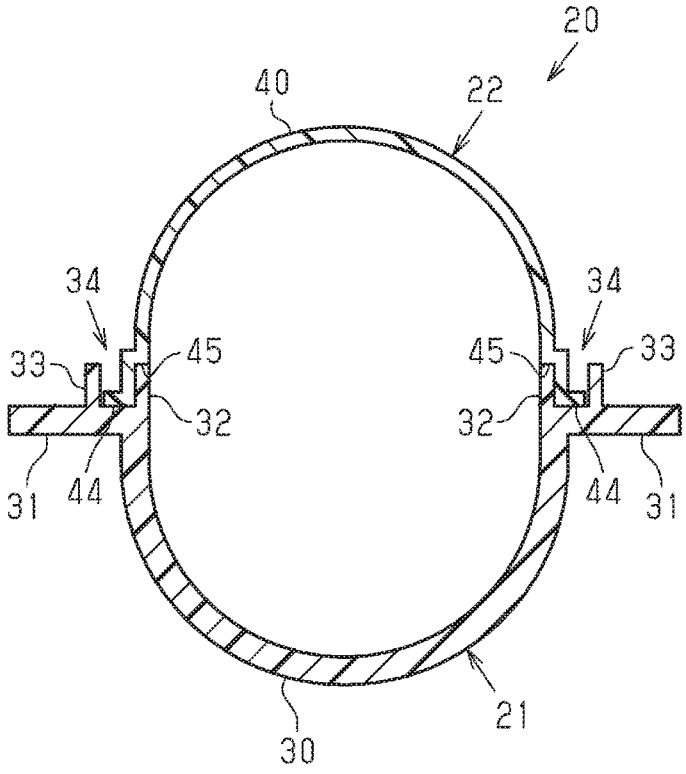
FIG. 4 is a cross-sectional view taken along line 4-4 in FIG. 2A.

As shown in FIGS. 3 and 4, in the present embodiment, the projection width of each rib 44, specifically, the width of the distal end of each rib 44 is less than the opening width of the groove 34 of the first segment 21 and greater than the space between inner surface of the groove 34 and the end of each projection 35. The rib 44 is fitted into the groove 34 so that the projections 35 of the first segment 21 locally compress the rib 44 in the width direction of the groove 34.

The two ends of the arcuate cross section of the second duct portion 40 each include a step 45. The step 45 has the form of a single step of which the distal end is located outward from the proximal end. The step 45 extends over the entire length of the second duct portion 40. The inner wall 32 of the first segment 21 is fitted to the inner side of the step 45. Thus, a step is not formed at a boundary between an inner surface of the inner wall 32 of the first segment 21 and an inner surface of the second segment 22.

The procedure for assembling the intake duct 20 and the operation of the intake duct 20 will now be described.

To assemble the intake duct 20, the inner walls 32 of the first segment 21 are fitted to the inner sides of the steps 45 of the second segment 22, and the ribs 44 of the second segment 22 are pressed into the grooves 34 of the flange portions 31 of the first segment 21.

In the present embodiment, the projection width of the ribs 44 of the second segment 22 is less than the opening width of the grooves 34 of the first segment 21. This allows the first segment 21 and the second segment 22 to be coupled together by pressing the ribs 44, which have a smaller projection width, into the grooves 34, which have a larger width.

In the present embodiment, as shown in FIG. 3, the space between the end of each projection 35 in the groove 34 and the inner surface of the groove 34 increases toward the opening of the groove 34. Thus, when the ribs 44 of the second segment 22 are pressed into the grooves 34 of the first segment 21, the ribs 44 can be elastically deformed. Thus, the grooves 34 and the ribs 44 do not have to be accurately positioned. In this case, the ribs 44 of the second segment 22 are elastically deformed in conformance with outer surfaces of the projections 35 in the grooves 34 of the first segment 21 and the inner surfaces of the grooves 34 so that the ribs 44 are guided to proper positions in the grooves 34.

In this manner, according to the present embodiment, regardless of the projections 35 in the grooves 34 of the first segment 21, the ribs 44 of the second segment 22 are easily fitted into the grooves 34. Thus, the first segment 21 and the second segment 22 are easy to couple. This facilitates assembling of the intake duct 20.

Figure 5:
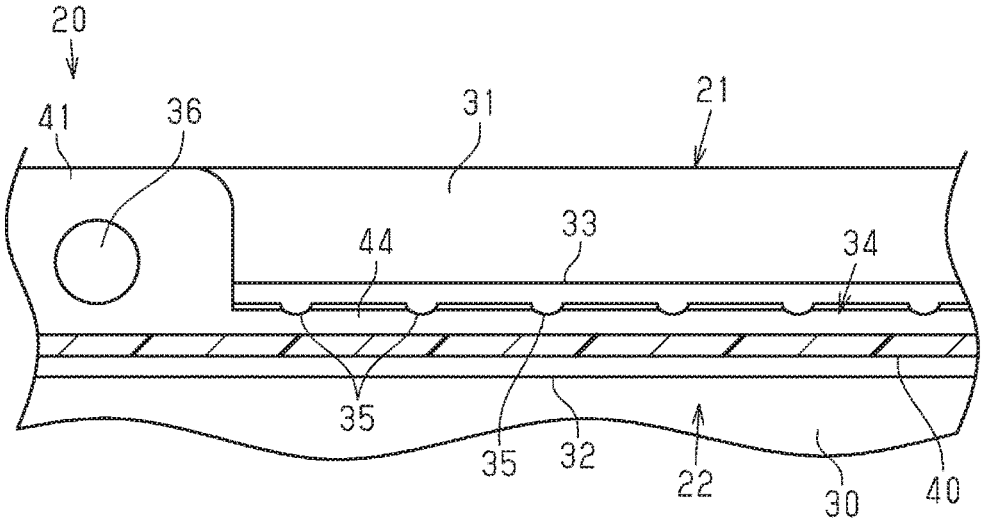
FIG. 5 is an enlarged cross-sectional plan view showing a groove and its periphery.

As shown in FIGS. 3 and 5, when the ribs 44 of the second segment 22 have been pressed into the grooves 34 of the first segment 21, the ribs 44 are compressed in the grooves 34 by the projections 35 arranged at equal intervals in the grooves 34 and the inner walls 32, which form the inner surfaces of the grooves 34. The ribs 44 are pressed in the grooves 34 against the inner walls 32 by the projections 35. This increases the planar pressure applied to the portion of contact between the ribs 44 of the second segment 22 and the inner walls 32 of the first segment 21 thereby improving the seal at the portion where the first segment 21 and the second segment 22 are coupled together.

With an intake duct structured so that ribs are fitted into grooves that do not include projections, the ribs would be entirely compressed in the grooves. Thus, to obtain a predetermined level of planar pressure at the portion of contact between the inner surfaces of the grooves and the outer surfaces of the projections, the opening width of the grooves and the projection width of the ribs need to be managed with high accuracy. However, in the present embodiment, the second segment 22 is formed from a nonwoven fabric. Thus, it is difficult to form the second segment 22 with high dimensional accuracy. Accordingly, it is difficult to accurately manage the projection width of the ribs 44, which form parts of the second segment 22.

In the present embodiment, the projections 35 are arranged in the grooves 34, and the ribs 44 are elastically deformed when fitted between the projections 35 and the inner surfaces of the grooves 34. The ribs 44 are partially compressed in the grooves 34. This reduces differences in the planar pressure that would be caused by differences in the projection width of the ribs 44 in comparison with when the ribs are entirely compressed. The present embodiment allows the predetermined level of planar pressure to be applied to the portion of contact between the inner surfaces of the grooves 34 and the outer surfaces of the ribs 44 even when there are slight differences in the opening width of the grooves 34 and the projection width of the ribs 44. This also easily forms the intake duct 20.

Figure 6:
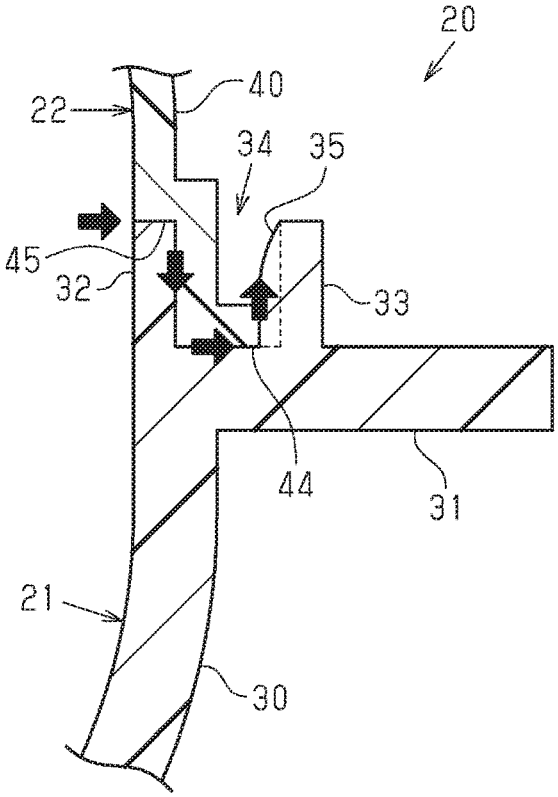
FIG. 6 is an enlarged cross-sectional side view showing the groove including a projection and its periphery.

In the present embodiment, as shown in FIG. 6, at the part where the inner wall 32 of the first segment 21 is fitted to the inner side of the step 45 of the second segment 22 and the rib 44 of the second segment 22 is fitted into the groove 34 of the first segment 21, the outer surface of the rib 44 joined with the inner surface of the groove 34 has a complicated (i.e., labyrinth) shape. This prevents air outside the intake duct 20 from entering the intake duct 20 and air inside the intake duct 20 from leaking out of the intake duct 20 through the surface where the outer surface of the rib 44 joins the inner surface of the groove 34.

If manufacturing errors increase differences in the projection width of the ribs 44 of the second segment 22, differences in the compressive deformation amount of the ribs 44 will increase in the grooves 34. This will increase differences in the planar pressure applied to the portion of contact between the ribs 44 and the inner walls 32 and thereby increase differences in the seal at the portion where the first segment 21 and the second segment 22 are coupled together. As described above, in the present embodiment, when forming the second segment 22 with a nonwoven fabric, it is difficult to manage the projection width of the ribs 44, which form parts of the second segment 22, with high accuracy.

Figure 7:
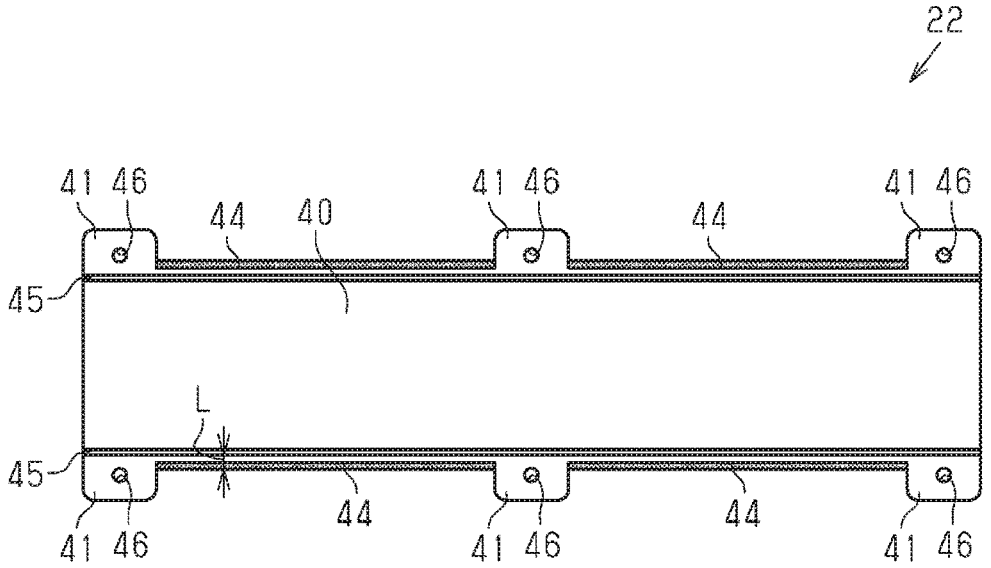
FIG. 7 is a plan view of a second segment.

In this respect, in the present embodiment, the distal end of each rib 44 has an L-shaped cross section and is bent outward. Accordingly, the shaded regions shown in FIG. 7, specifically, the outwardly bent distal end of each rib 44 of the second segment 22 may be cut to easily adjust dimension L of the rib 44 in the width direction. In this manner, the present embodiment facilitates adjustment for obtaining appropriate seal at the portion where the first segment 21 and the second segment 22 are coupled together.

Figure 8:
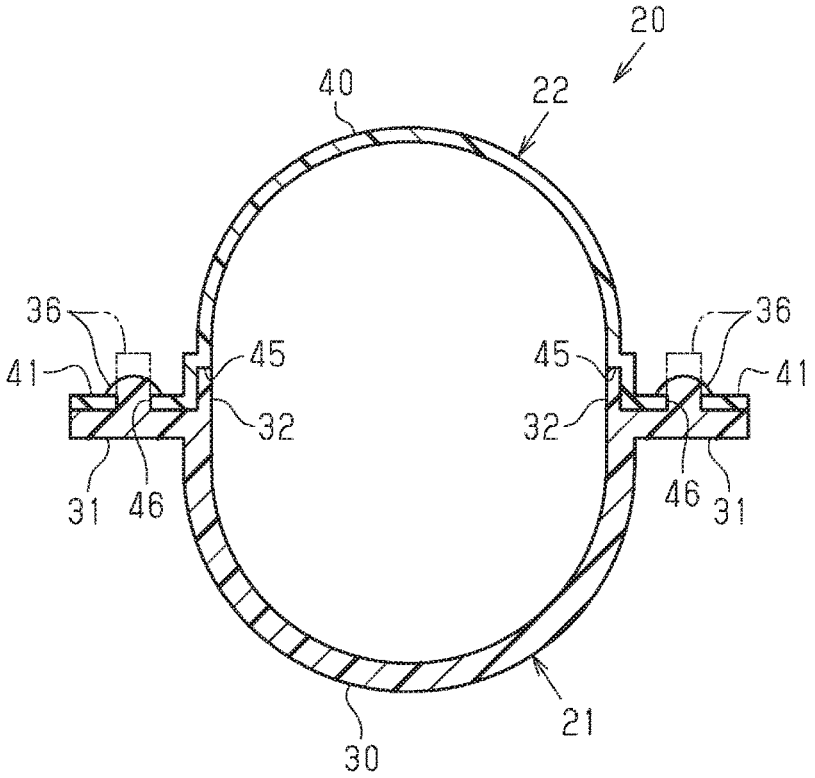
FIG. 8 is a cross-sectional view taken along line 8-8 in FIG. 2A.

As shown in FIG. 1, when the ribs 44 of the second segment 22 are pressed into the grooves 34 of the first segment 21 to assemble the intake duct 20, the swaging portions 36 of the flange portions 31 of the first segment 21 are inserted into the through-holes 46 of the fixing portions 41 of the second segment 22 accordingly. Then, as shown in FIG. 8, heat swaging is performed to heat, press, and plastically deform the distal ends of the swaging portions 36 so that the edge of the through-holes 46 of the fixing portions 41 are held between the distal ends of the swaging portions 36 and the flange portions 31. In the present embodiment, such heat swaging fixes the fixing portions 41 of the second segment 22 to the flange portions 31 of the first segment 21.

In the present embodiment, the locations of the swaging portions 36 formed on the flange portions 31 and the locations of the through-holes 46 in the fixing portions 41 are determined so that when the fixing portions 41 are fixed to the flange portions 31, the inner surfaces of the fixing portions 41 on the second duct portion 40 of the second segment 22 are pressed against the outer surfaces of the inner walls 32 of the first segment 21. Thus, when the fixing portions 41 have been fixed to the flange portions 31 through heat swaging, the inner surfaces of the fixing portions 41 on the second duct portion 40 of the second segment 22 are pressed against the outer surfaces of the inner walls 32 of the first segment 21. This increases the planar pressure applied to the portion where the surfaces are in contact. In this manner, in the intake duct 20 of the present embodiment, the seal is improved at the portion where the first segment 21 and the second segment 22 are coupled together even where the fixing portions 41 of the second segment 22 are fixed to the flange portions 31 of the first segment 21.

As described above, the present embodiment has the following advantages.

(1) The ribs 44, which have a smaller projection width, are pressed into the grooves 34, which have a larger width. This facilitates the coupling of the first segment 21 and the second segment 22 and the task for assembling the intake duct 20. The projections 35 in the grooves 34 of the first segment 21 press the ribs 44 of the second segment 22 against the inner walls 32, which serve as the inner surfaces of the grooves 34. This improves the seal at the portion where the first segment 21 and the second segment 22 are coupled together.

(2) The amount of projection of the projection 35 from the inner surface of the outer wall 33 at a portion proximate to the opening of the groove 34 increases as the opening of the groove 34 becomes farther. Thus, regardless of the projections 35 in the grooves 34 of the first segment 21, the ribs 44 of the second segment 22 are easily fitted into the grooves 34.

(3) The projections 35 are formed only on the outer one of the two inner surfaces of the groove 34. Thus, the projections 35 arranged on the outer walls 33 press the ribs 44 of the second segment 22 against the inner walls 32 to increase the planar pressure applied to the portion of contact between the ribs 44 and the inner walls 32.

(4) The distal end of each rib 44 has an L-shaped cross section and is bent outward. Accordingly, the distal end of the outwardly bent rib 44 of the second segment 22 may be cut to easily adjust the dimension of the rib 44 in the width direction. This facilitates adjustment for obtaining the appropriate seal at the portion where the first segment 21 and the second segment 22 are coupled together.

The above illustrated embodiment may be modified as follows. The above-described embodiments and the following modifications can be combined as long as the combined modifications remain technically consistent with each other.

Figure 9:
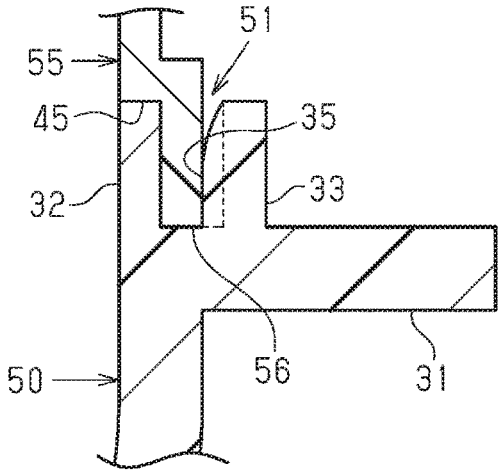
FIG. 9 is an enlarged cross-sectional side view showing a groove and its periphery of an intake duct according to a modification.

As shown in FIG. 9, a portion of a first segment 50 that is fitted into a groove 51, that is, the distal end of a rib 56 of a second segment 55 may be formed to have an I-shaped cross section that is not bent outward.

Figure 10:
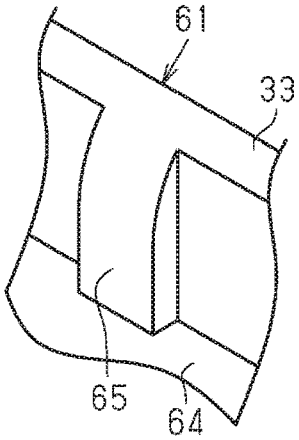
FIG. 10 is an enlarged perspective view showing a projection and its periphery of an intake duct according to another modification.

As shown in FIG. 10, a projection 65 of a first segment 61 may have a rectangular cross section and extend from the bottom to an open end of a groove 64.

Figure 11:
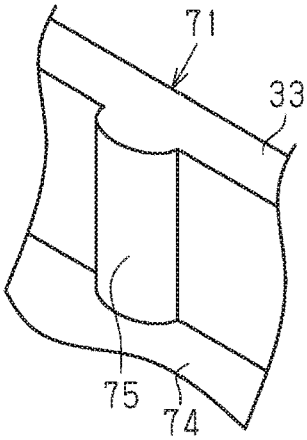
FIG. 11 is an enlarged perspective view showing a projection and its periphery of an intake duct according to yet another modification.

As shown in FIG. 11, a portion of a projection 75 of a first segment 71 proximate to an opening of a groove 74 may be shaped so that the amount of projection from the inner surface of the groove 74 is fixed. In the example shown in FIG. 11, the space between the end of the projection 75 and the inner surface of the groove 74 is fixed at any portion in the groove 74.

The projections 35 of the first segment 21 are formed only on the outer walls 33. Instead, the projections 35 may be formed only on the inner walls 32. This improves the seal of the entire intake duct when the outer walls 33 extend over the entire length of the flange portions 31 of the first segment 21 in the extending direction.

The inner walls 32 and the outer walls 33 of the first segment 21 and the ribs 44 of the second segment 22 may extend over the entire length of the intake duct 20 in the extending direction.

The first segment 21 may be made of a nonwoven fabric that is harder than the second segment 22. The second segment 22 may be made of urethane foam. The intake duct of the above embodiment can be applied to any intake duct as long as the first segment 21 of the intake duct is made of a material that is harder than the second segment 22.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An intake duct for an internal combustion engine, the intake duct comprising:

a plurality of segments that extend in an extending direction and are coupled together into a tubular shape, wherein the plurality of segments include at least a first segment and a second segment, the first segment is formed from a material harder than the second segment, the first segment includes a groove that extends in the extending direction in a portion coupled to the second segment and projections that project from one of two inner surfaces of the groove so as to decrease a width of the groove, the projections being spaced apart from each other in the extending direction inside the groove, the groove includes a bottom wall, an inner wall and an outer wall, the inner wall and the outer wall extend upwardly from the bottom wall, and face each other, a lower end of the outer wall contacts the bottom wall throughout an entire length of the outer wall in the extending direction, each of the projections extends from the bottom wall to an upper opening end of the groove, the second segment is formed from a material that allows for elastic deformation, the second segment includes a rib at a portion where the second segment is joined with the first segment, the rib extending in the extending direction and having a projection width that is less than an opening width of the groove, and the rib is fitted into the groove so that the projections locally compress the rib in a width direction of the groove.

2. The intake duct according to claim 1, wherein the projections each include a portion proximate to an opening of the groove of which a projection amount from the inner surface increases as the opening of the groove becomes farther.

3. The intake duct according to claim 1, wherein the projections are formed only on an outer one of the two inner surfaces.

4. The intake duct according to claim 1, wherein the rib includes a distal end having an L-shaped cross section and bent toward the projections.

5. The intake duct according to claim 1, wherein the first segment is formed from a synthetic resin material, and the second segment is formed from a fibrous material.

6. An intake duct for an internal combustion engine, the intake duct comprising:

a plurality of segments that extend in an extending direction and are coupled together into a tubular shape, wherein the plurality of segments include at least a first segment and a second segment, the first segment is formed from a material harder than the second segment, the first segment includes a groove that extends in the extending direction in a portion coupled to the second segment and projections that project from one of two inner surfaces of the groove so as to decrease a width of the groove, the projections being spaced apart from each other in the extending direction inside the groove, the second segment is formed from a material that allows for elastic deformation, the second segment includes a rib at a portion where the second segment is joined with the first segment, the rib extending in the extending direction, the rib is fitted into the groove so that the projections locally compress the rib in a width direction of the groove, the rib includes a first rib portion and a second rib portion connected each other so as to have an L-shaped cross section, the second rib portion extending from the first rib portion toward the projections in the width direction of the groove, and a length of the second rib portion from a proximal end connected to the first rib portion to a distal end of the second rib portion is less than an opening width of the groove.

7. An intake duct for an internal combustion engine, the intake duct comprising:

a plurality of segments that extend in an extending direction and are coupled together into a tubular shape, wherein the plurality of segments include at least a first segment and a second segment, the first segment is formed from a material harder than the second segment, the first segment includes a groove that extends in the extending direction in a portion coupled to the second segment and projections that project from one of two inner surfaces of the groove so as to decrease a width of the groove, the projections being spaced apart from each other in the extending direction inside the groove, the second segment is formed from a material that allows for elastic deformation, the second segment includes a rib at a portion where the second segment is joined with the first segment, the rib extending in the extending direction and having a projection width that is less than an opening width of the groove, and the rib is fitted into the groove so that the projections locally compress the rib in a width direction of the groove, wherein the first segment includes a first duct portion and a flange portion that projects outward from an end of the first duct portion, the flange portion includes an inner wall, which projects from the end of the first duct portion, and an outer wall, the groove is formed by a portion between the inner wall and the outer wall, the second segment includes a second duct portion and the rib, an end of the second duct portion includes a step, the step includes a proximal end and a distal end that is located outward from the proximal end, the rib extends from the distal end of the step, and the inner wall of the first segment is fitted to an inner side of the step.

* * * * *